US006994580B1

(12) United States Patent
Chen

(10) Patent No.: US 6,994,580 B1
(45) Date of Patent: Feb. 7, 2006

(54) NETWORK PLUG

(75) Inventor: Hsin-Huei Chen, Taoyuan Hsien (TW)

(73) Assignee: Excellence Wire Ind. Co., Ltd., Taoyuan Hsien (TW)

( * ) Notice: Subject to any disclaimer, the term of this patent is extended or adjusted under 35 U.S.C. 154(b) by 0 days.

(21) Appl. No.: 10/968,026

(22) Filed: Oct. 20, 2004

(51) Int. Cl.
*H01R 13/625* (2006.01)

(52) U.S. Cl. ..... 439/344; 439/372

(58) Field of Classification Search ..... 439/344, 439/345, 372
See application file for complete search history.

(56) References Cited

U.S. PATENT DOCUMENTS

| | | | | |
|---|---|---|---|---|
| 4,919,627 | A * | 4/1990 | Cable | 439/263 |
| 6,413,113 | B2 * | 7/2002 | Uher et al. | 439/372 |
| 6,793,515 | B1 * | 9/2004 | Gwiazdowski et al. | 439/344 |
| 6,866,532 | B1 * | 3/2005 | Huang | 439/344 |

* cited by examiner

*Primary Examiner*—Gary Paumen
(74) *Attorney, Agent, or Firm*—Troxell Law Office, PLLC

(57) ABSTRACT

A network plug includes a plug body, two locking bars pivotally mounted in the top wall of the plug body, a jacket coupled to the rear side of the plug body and movable relative to the plug body in axial direction within a limited distance, and a working plate mounted in the jacket and movable with the jacket relative to the plug body to move the locking bars between the locking position to lock the network plug to a network socket, and the unlocking position to unlock the network plug from the network socket.

1 Claim, 8 Drawing Sheets

NETWORK PLUG

BACKGROUND AND SUMMARY OF THE INVENTION

The present invention relates to a network plug for connection to a network socket and more particularly, to an improved structure of network plug, which uses a slide to move two locking bars between the locking position and the unlocking position to eliminate the drawbacks of conventional network plugs that use a clip for locking.

FIG. 1 shows a conventional network plug 8 for use with a network socket 9. As illustrated, the network plug 8 has a springy protruding clip 81 for locking. The protruding clip 81 has two stop edges 811 at two sides. When inserted the network plug 8 into the receiving hole 91 of the network socket 9, the stop edges 811 are respectively engaged with two locating blocks 911 inside the receiving hole 91 of the network socket 9, and therefore the network plug 8 is locked to the network socket 9.

This design of network plug 8 is still not satisfactory in function. Before inserting the network plug 8 into the network socket 9 or removing the network plug 8 from the network socket 9, the user must press the spring clip 81 with the finger so that the network plug 8 can be moved in and out of the network socket 9. This operation method requires much effort. Another drawback of this design of network plug is that the springy clip 81 wears quickly with use. Further, because the springy clip 81 extends obliquely upwardly from the top side of the body of the network plug 8, the network plug 8 requires much installation space.

The present invention has been accomplished under the circumstances in view. It is therefore main object of the present invention to provide a network plug that eliminates the aforesaid drawbacks. According to one aspect of the present invention, the network plug comprises a plug body, two locking bars pivotally mounted in the top wall of the plug body, a jacket coupled to the rear side of the plug body and movable relative to the plug body in axial direction within a limited distance, and a working plate mounted in the jacket and movable with the jacket relative to the plug body to move the locking bars between the locking position to lock the network plug to a network socket, and the unlocking position to unlock the network plug from the network socket. According to another aspect of the present invention, the network plug eliminates the use of the projecting clip as seen in conventional network plugs, therefore the network plug of the present invention is durable in use, and requires less installation space.

DETAILED DESCRIPTION OF THE INVENTION

Figure 1:
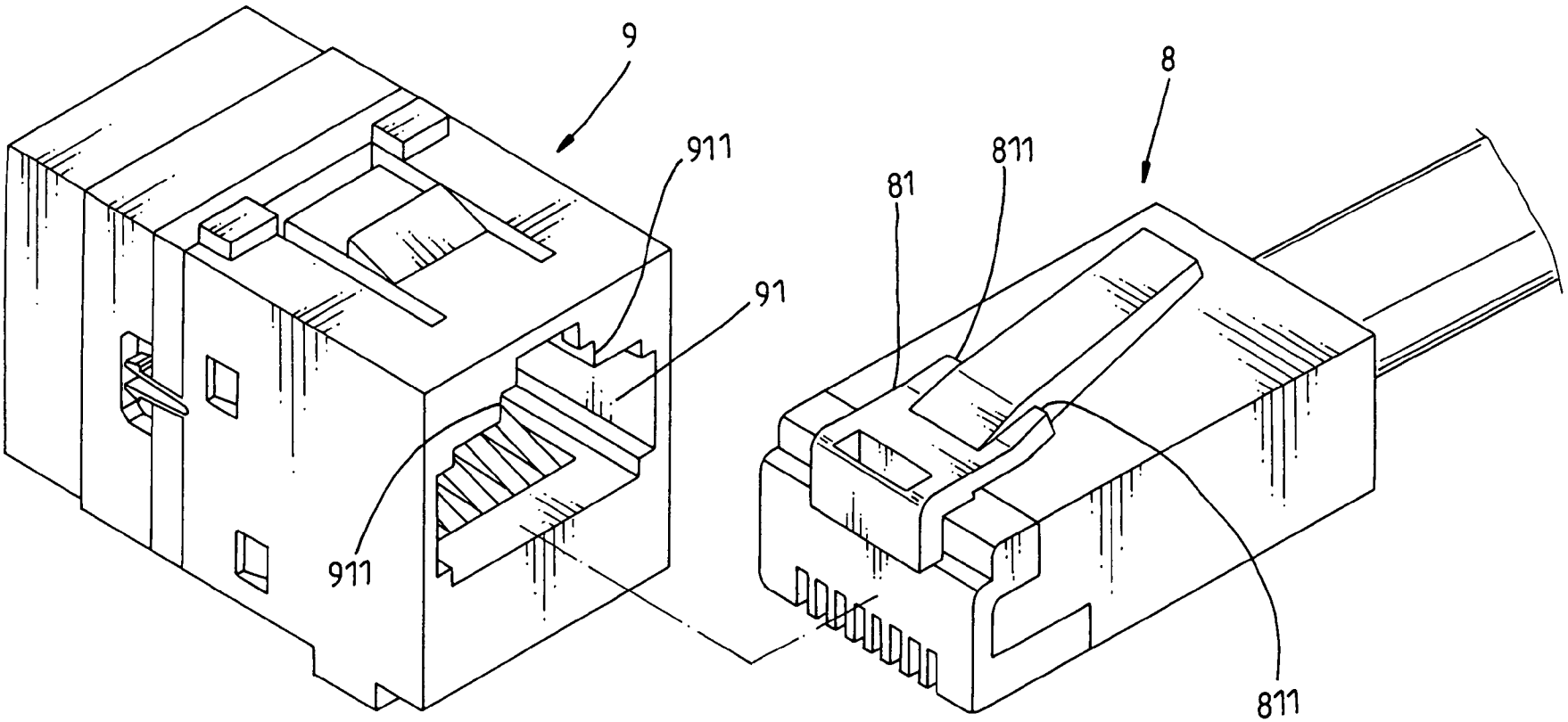
Fig. 1 PRIOR ART
FIG. 1 is a perspective view of a conventional network plug and network socket.
Figure 2:
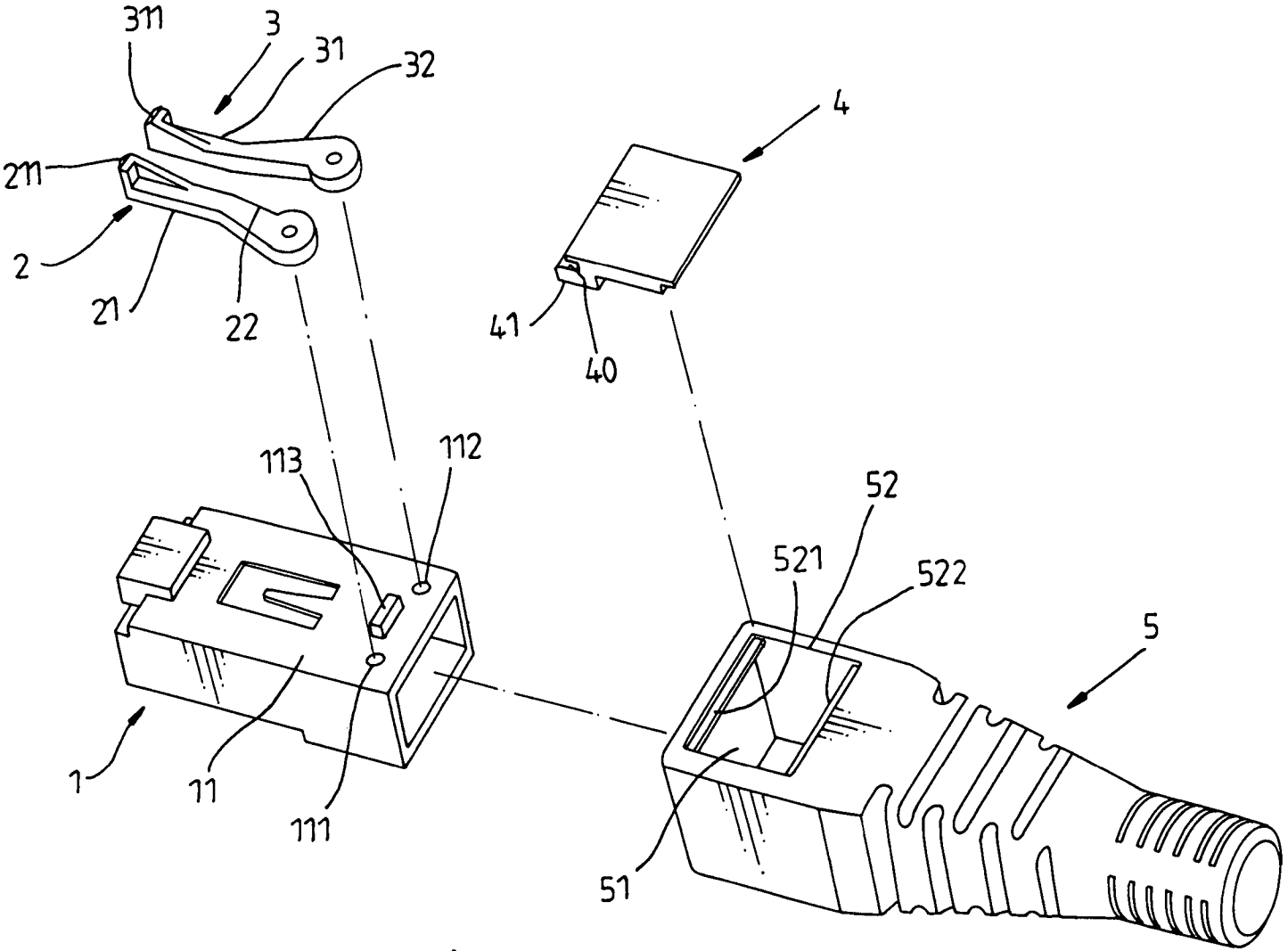
FIG. 2 is an exploded view of a network plug according to the present invention.
Figure 3:
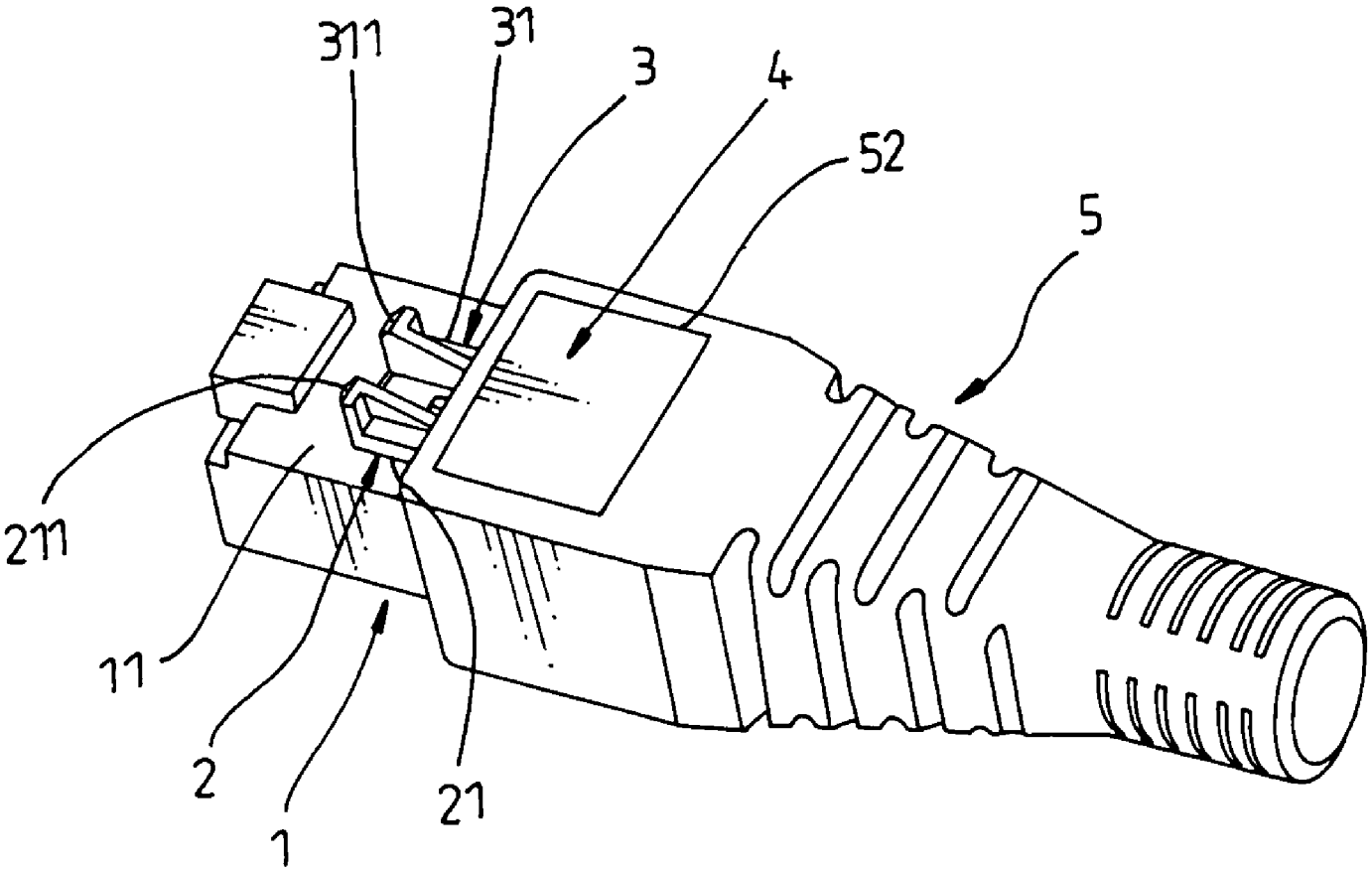
FIG. 3 is an elevational assembly view of the network plug according to the present invention.

Referring to FIGS. 2 and 3, a network plug is shown comprised of a plug body 1, a first locking bar 2, a second locking bar 3, a working plate 4, and a jacket 5.

Referring to FIG. 2 again, the plug body 1 has a stop block 113 protruded from the top wall 11 thereof near the rear side, and two pivot holes 111 and 112 formed in the top wall 11 near the rear side and equally spaced from the stop block 113 at two sides.

Figure 4:
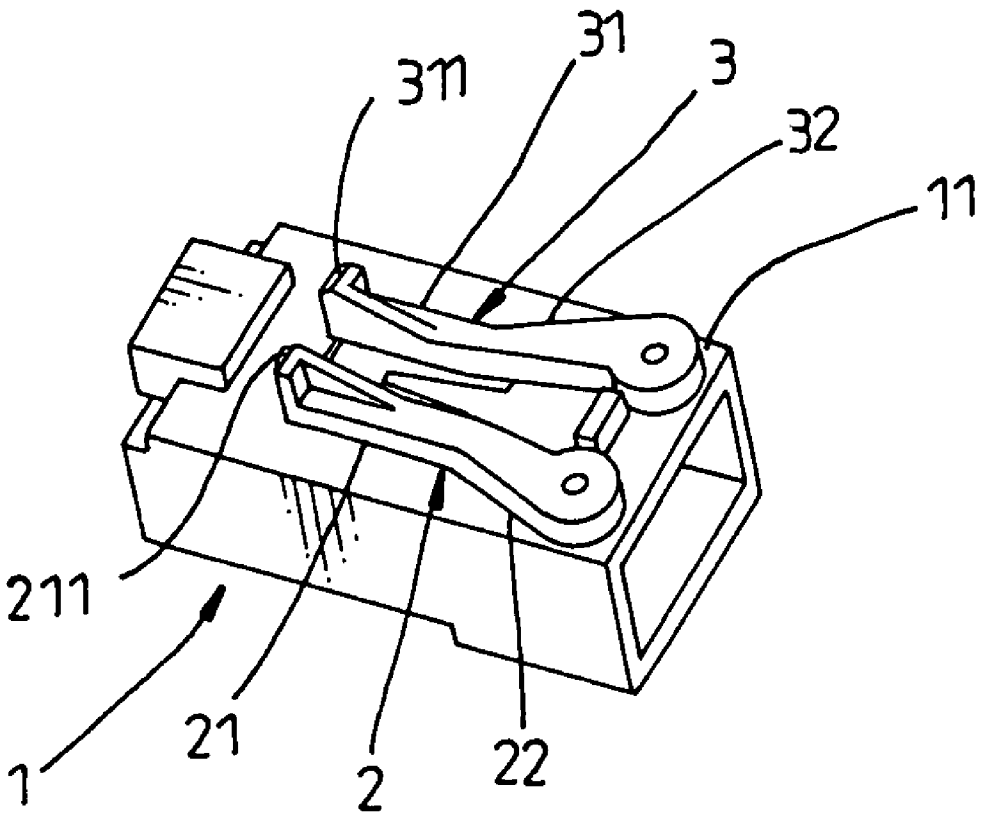
FIG. 4 is an elevational view of a part of the present invention, showing the two locking bars respectively pivoted to the plug body.
Figure 5:
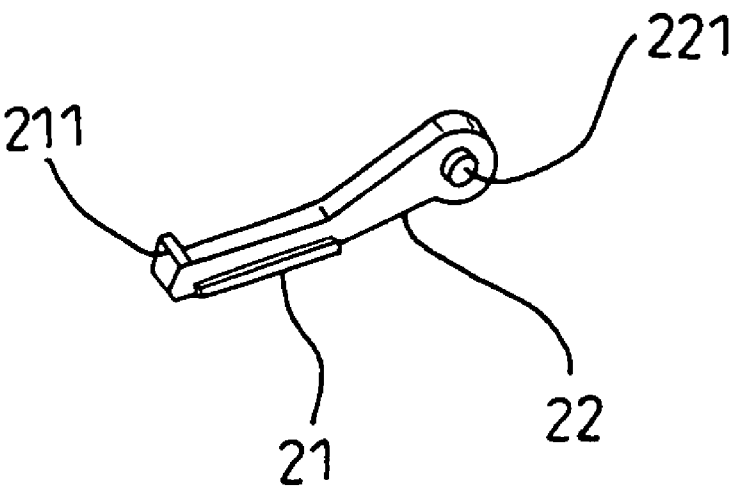
FIG. 5 is an elevational view of the first locking bar according to the present invention.
Figure 6:
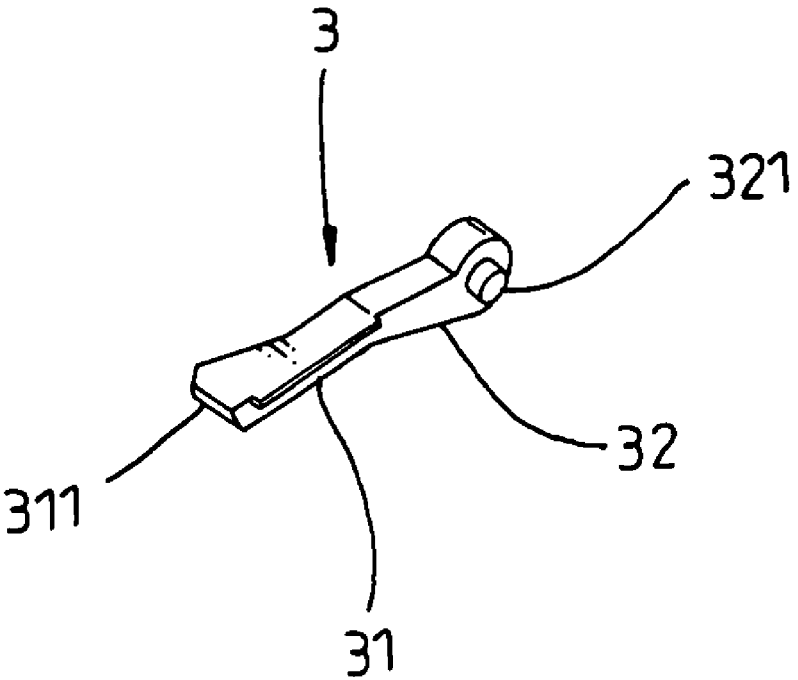
FIG. 6 is an elevational view of the second locking bar according to the present invention.

Referring to FIGS. 4–6, the first locking bar 2 has a front working part 21 terminating in a hook 211, and a rear mounting part 22 obliquely backwardly extended from the rear side of the front working part 21 and provided with a pivot pin 221. The pivot pin 221 is pivotally inserted into one pivot hole 111 of the plug body 1.

Referring to FIGS. 4–6 again, the second locking bar 3 has a front working part 31 terminating in a hook 311, and a rear mounting part 32 obliquely backwardly extended from the rear side of the front working part 21 and provided with a downwardly extended pivot pin 321. The pivot pin 321 is pivotally inserted into the other pivot hole 112 of the plug body 1.

Figure 7:
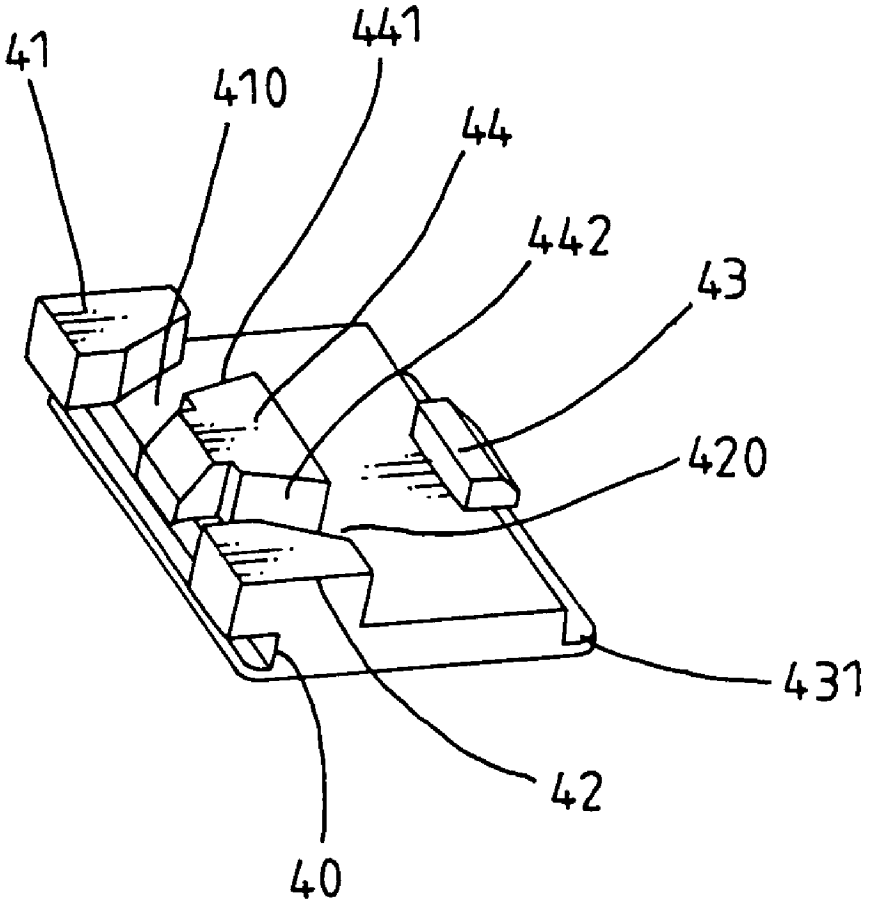
FIG. 7 is an oblique bottom elevation of the working plate according to the present invention.

Referring to FIG. 7, the working plate 4 has two front blocks 41 and 42 bilaterally extended from the bottom wall near the front side and defining with the bottom wall a front locating groove 40, a rear block 43 extended from the bottom wall near the rear side and defining with the bottom wall a rear locating groove 431, and a push block 44 protruded from the bottom wall between the front blocks 41 and 42. The push block 44 has two beveled side edges 441 and 442, which define with the front blocks 41 and 42 two backwardly outwardly extended sliding ways 410 and 420 at two sides of the push block 44.

Figure 8:
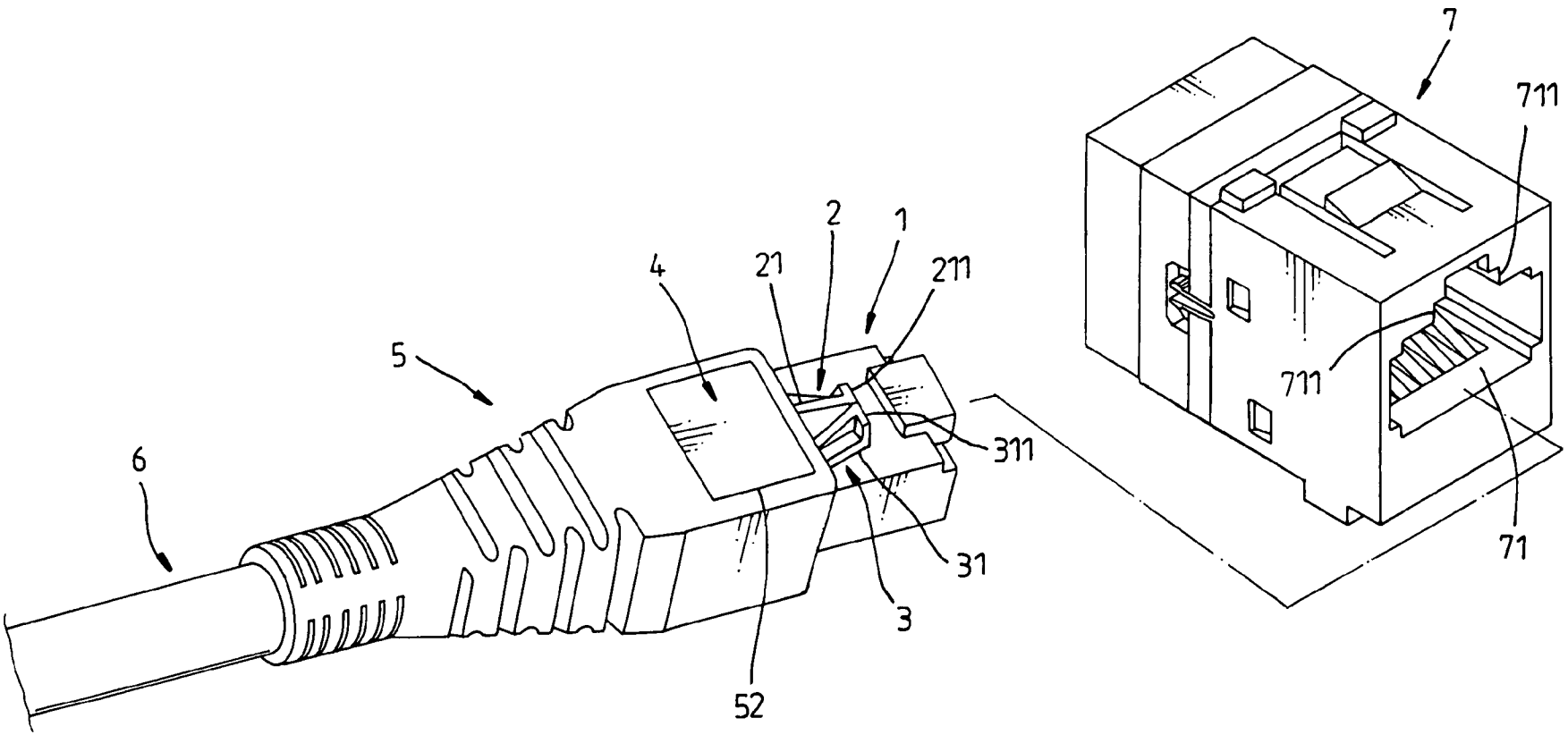
FIG. 8 is an elevational view before connection of the network plug to a network socket according to the present invention.

Referring to FIG. 8 and FIGS. 2 and 3 again, the jacket 5 has a receiving chamber 51 axially extended through the front and rear sides thereof, which has a broader front side that receives the rear part of the plug body 1 and a narrower rear side that receives a communication cable 6, a top mounting hole 52 through the top wall near the front side in communication with the receiving chamber 51 for receiving the working plate 4, and two locating flanges 521 and 522 respectively transversely suspended in the front and rear sides of the top mounting hole 52 and respectively engaged into the front locating groove 40 and rear locating groove 431 of the working plate 4 to hold the working plate 4 in the top mounting hole 52. After installation of the working plate 4 in the top mounting hole 52 of the jacket 5, the push block 44 is interposed between the locking bars 2 and 3, and the locking bars 2 and 3 are held extending through the sliding ways 410 and 420 of the working plate 4.

Figure 9:
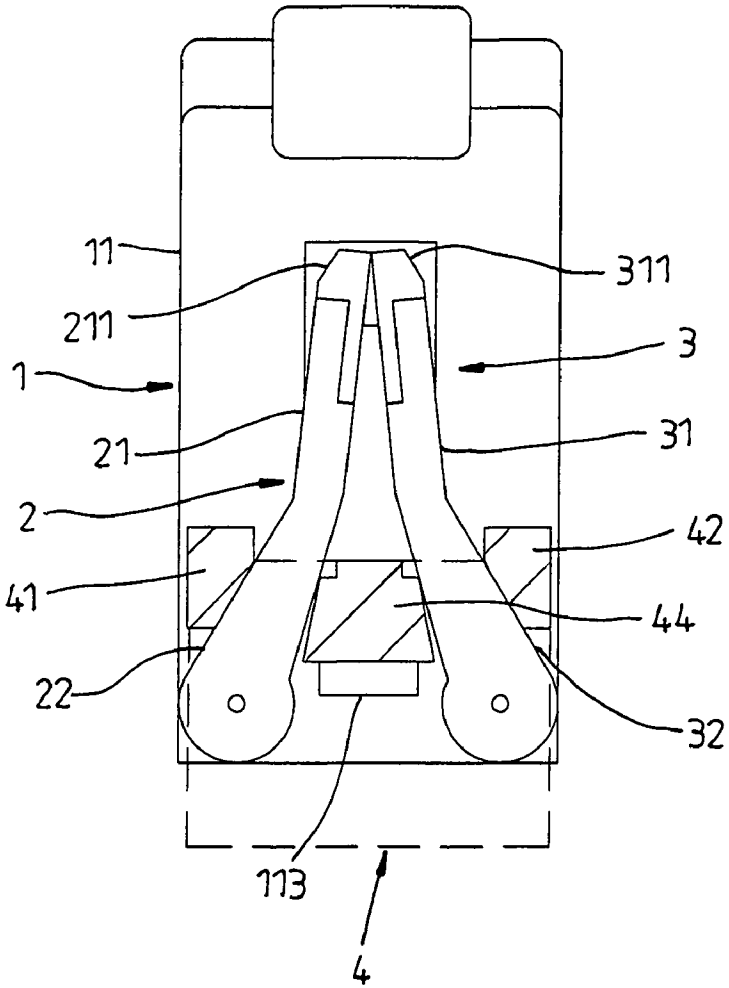
FIG. 9 is a sectional plain view of the present invention, showing the locking bars moved to the unlocking position.
Figure 10:
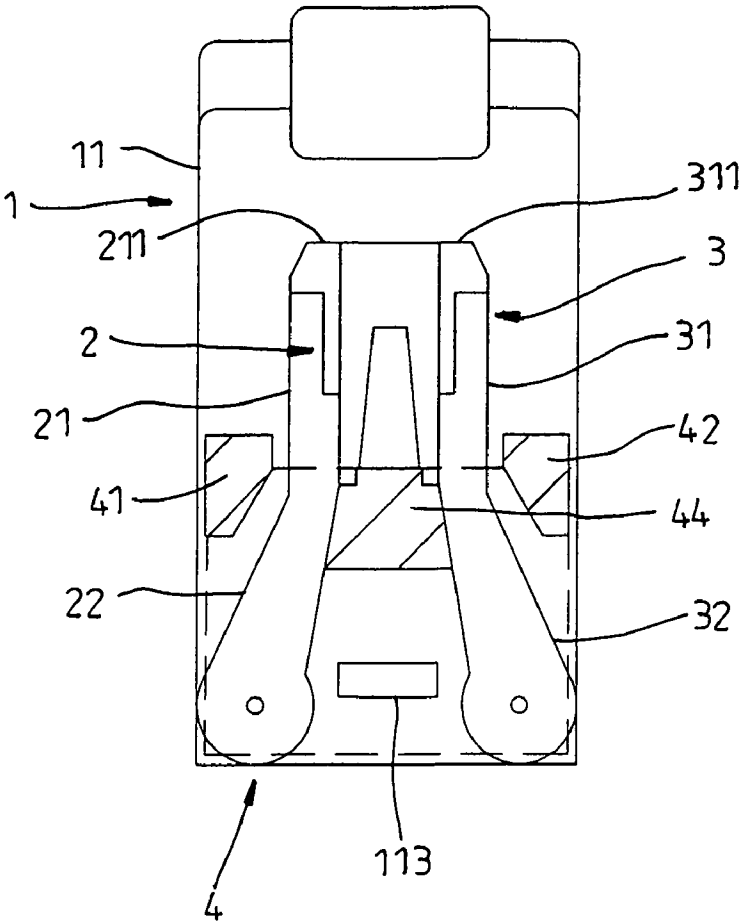
FIG. 10 is a sectional plain view of the present invention, showing the locking bars moved to the locking position.

Referring to FIGS. 9 and 10 and FIG. 8 again, when inserted the plug body 1 of the network plug into the receiving hole 71 of a network socket 7, the jacket 5 is pushed forwards relative to the plug body 1 to move the push block 44 into the area between the front working part 21 of the first locking bar 2 and the front working part 31 of the second locking bar 3 to the extent where the push block 44 is stopped against the stop block 113 of the plug body 1. At this time, the locking bars 2 and 3 are respectively turned outwards to hook the hooks 211 and 311 on a respective locating block 711 inside the receiving hole 71, and therefore the network plug is locked to the network socket 7 (see FIG. 10). On the contrary, when pulled the jacket 5 backwards relative to the plug body 1, the push block 44 is moved from the area between the front working part 21 of the first locking bar 2 and the front working part 31 of the second locking bar 3 into the area between the rear mounting part 22 of the first locking bar 2 and the rear mounting part 32 of the second locking bar 3. At this time, the locking bars 2 and 3 are respectively turned inwards to disengage the hooks 211 and 311 from the respective locating blocks 711 inside the receiving hole 71, and therefore the network plug is unlocked from the network socket 7 (see FIG. 9).

As indicated above, the invention provides the following features:

1. By means of moving the jacket 5 axially relative to the plug body 1, the network plug is alternatively set between the locking position and the unlocking position. Therefore, the mounting and dismounting operation of the network plug is simple and laborsaving.

2. Because the invention eliminates the use of the projecting clip as seen in a conventional network plug, the network plug of the present invention requires less installation space and is durable in use.

What is claimed is:

1. A network plug comprising:

a plug body, said plug body having a top wall, a stop block protruded from the top wall near a rear side thereof, and two pivot holes formed in the top wall near a rear side thereof and equally spaced from said stop block at two sides;

a first locking bar and a second locking bar, said first locking bar and said second locking bar each having a front working part, a hook protruded from a front side of said front working part, and a rear mounting part obliquely backwardly extended from a rear side of said front working part and respectively pivotally connected to the pivot holes of said plug body;

a jacket coupled to said plug body and axially movable relative to said plug body between a front position and a rear position, said jacket having a receiving chamber axially extended through front and rear sides thereof, said receiving chamber having a broad front side that receives a rear part of said plug body and a narrow rear side that receives a communication cable, a top mounting hole through a top wall thereof in communication with said receiving chamber, and a front locating flange and a rear locating flange respectively transversely suspended in front and rear sides of said top mounting hole; and a working plate mounted in the top mounting hole of said jacket and movable with said jacket relative to said plug body to move said first locking bar and said second locking bar between a locking position and an unlocking position, said working plate comprising two front blocks bilaterally extended from a bottom wall thereof near a front side, a front locating groove defined in said front blocks and engaged with said front locating flange of said jacket, a rear block extended from the bottom wall near a rear side, a rear locating groove defining in said rear block and engaged with said rear locating flange of said jacket, and a push block protruded from the bottom wall between said front blocks and interposed between said first locking bar and said second locating bar, said push block having two beveled side edges, which define with said front blocks two backwardly outwardly extended sliding ways at two sides of said push block for receiving said first locking bar and said second locking bar.

* * * * *